US011655976B2

(12) United States Patent
Acosta Herrero et al.

(10) Patent No.: US 11,655,976 B2
(45) Date of Patent: May 23, 2023

(54) GAS BURNER ARRANGEMENT AND HOUSEHOLD COOKING APPLIANCE

(71) Applicant: BSH Hausgeräte GmbH, Munich (DE)

(72) Inventors: Luis Acosta Herrero, Maliaño (ES); Melca Gutierrez Humara, La Penilla (ES); Alberto Lopez Ortiz, Santander (ES); Luis Antonio Palacios Valdueza, Astillero (ES); Emilio Placer Maruri, Liencres (ES)

(73) Assignee: BSH Hausgeräte GmbH

( * ) Notice: Subject to any disclaimer, the term of this patent is extended or adjusted under 35 U.S.C. 154(b) by 479 days.

(21) Appl. No.: 16/641,265

(22) PCT Filed: Aug. 24, 2018

(86) PCT No.: PCT/IB2018/056425
§ 371 (c)(1),
(2) Date: Feb. 24, 2020

(87) PCT Pub. No.: WO2019/048971
PCT Pub. Date: Mar. 14, 2019

(65) Prior Publication Data

US 2020/0182457 A1 Jun. 11, 2020

(30) Foreign Application Priority Data

Sep. 5, 2017 (ES) ..... ES201731070

(51) Int. Cl.
*F23D 14/06* (2006.01)
*F23D 14/64* (2006.01)
*F24C 3/08* (2006.01)

(52) U.S. Cl.
CPC ..... *F23D 14/06* (2013.01); *F23D 14/64* (2013.01); *F24C 3/085* (2013.01); *F23D 2900/14062* (2013.01)

(58) Field of Classification Search
CPC ..... F23D 14/06; F23D 14/64; F24C 3/085
(Continued)

(56) References Cited

U.S. PATENT DOCUMENTS

2006/0051718 A1 3/2006 Karnak et al.
2008/0202494 A1 8/2008 Paesani
(Continued)

FOREIGN PATENT DOCUMENTS

CN 101514814 A 8/2009
WO 9908046 A1 2/1999
WO 2016170497 A1 10/2016

OTHER PUBLICATIONS

National Search report ES 201731070 dated Nov. 21, 2018.
International Search Report PCT/IB2018/056425 dated Nov. 14, 2018.

*Primary Examiner* — Vivek K Shirsat
(74) *Attorney, Agent, or Firm* — Michael E. Tschupp; Andre Pallapies; Brandon G. Braun

(57) ABSTRACT

A gas burner arrangement for a household cooking appliance includes a hob plate and a gas burner mounted on the hob plate. The gas burner includes a first mixing chamber for mixing combustion gas with primary air, a second mixing chamber, separate from the first mixing chamber, for mixing combustion gas with primary air, at least one first primary air opening for supplying primary air to the first mixing chamber, and at least one second primary air opening for supplying primary air to the second mixing chamber. The at least one first primary air opening is arranged below the hob plate and the at least one second primary air opening is arranged above the hob plate.

28 Claims, 8 Drawing Sheets

(58) Field of Classification Search
USPC ..... 126/39 E, 39 R; 431/354
See application file for complete search history.

(56) References Cited

U.S. PATENT DOCUMENTS

| | | | | |
|---|---|---|---|---|
| 2011/0048400 | A1 | 3/2011 | Biagioli et al. | |
| 2012/0070791 | A1 | 3/2012 | Armanni et al. | |
| 2017/0108226 | A1* | 4/2017 | Moon | F24C 3/085 |

* cited by examiner

GAS BURNER ARRANGEMENT AND HOUSEHOLD COOKING APPLIANCE

CROSS-REFERENCES TO RELATED APPLICATIONS

This application is the U.S. National Stage of International Application No. PCT/IB2018/056425, filed Aug. 24, 2018, which designated the United States and has been published as International Publication No. WO 2019/048971 A1 and which claims the priority of Spanish Patent Application, Serial No. P201731070, filed Sep. 5, 2017, pursuant to 35 U.S.C. 119(a)-(d).

BACKGROUND OF THE INVENTION

The present invention relates to a gas burner arrangement for a household cooking appliance, and to a household cooking appliance having a gas burner arrangement of this kind.

Gas burners for household cooking appliances usually include a burner base, in which there may be provided a mixing chamber, a nozzle holder having a gas nozzle for injecting combustion gas into the mixing chamber, and a burner lid that is laid on the burner base and may have mixture outlet openings. When the combustion gas is injected into the mixing chamber, primary air is drawn in by suction, laterally between the gas nozzle and an inflow edge of the mixing chamber, and mixed with the combustion gas. The mixture of combustion gas and primary air that is formed in this way is supplied to a mixture distribution chamber provided between the burner base and the burner lid, and from there is distributed evenly to the mixture outlet openings, for the purpose of forming a flame. The primary air is usually supplied to the mixing chamber from below a hob plate on which the gas burner is mounted.

BRIEF SUMMARY OF THE INVENTION

Taking this as a starting point, an object of the present invention is to provide an improved gas burner arrangement.

Accordingly, a gas burner arrangement for a household cooking appliance is proposed. The gas burner arrangement includes a gas burner and a hob plate on which the gas burner is mounted, wherein the gas burner includes a first mixing chamber for mixing combustion gas with primary air, a second mixing chamber, separate from the first mixing chamber, for mixing combustion gas with primary air, at least one first primary air opening for supplying primary air to the first mixing chamber, and at least one second primary air opening for supplying primary air to the second mixing chamber, wherein the at least one first primary air opening is arranged below the hob plate and the at least one second primary air opening is arranged above the hob plate.

Because the second primary air opening is arranged above and not below the hob plate, it is possible to draw primary air in by suction from above the hob plate. This can prevent the burner flame from being extinguished if there are pressure pulses in an inner space of a household cooking appliance with a gas burner arrangement of this kind in a minimum burning operation.

The expression that the first mixing chamber is separate from the second mixing chamber should be understood to mean that there is preferably no fluidic connection between the first mixing chamber and the second mixing chamber. However, the first mixing chamber and the second mixing chamber are in particular arranged in a common burner casing of the gas burner. The hob plate includes a front side and, remote from the front side, a rear side. In relation to a direction of gravity, the front side is arranged above the rear side. The first primary air opening is intended to draw the primary air in by suction out of an inner space of the household appliance. By contrast, the second primary air opening is intended to draw the primary air in by suction not from the inner space but from an area surrounding the household cooking appliance. The hob plate may be for example a steel plate, in particular a steel sheet, a glass ceramic plate or a plate of tempered glass. The gas burner arrangement may include a plurality of gas burners. Preferably, the gas burner includes a first flame ring with which the first mixing chamber is associated and a second flame ring with which the second mixing chamber is associated. For this reason, the gas burner may also be designated a dual-ring gas burner.

According to one embodiment, the first mixing chamber and the second mixing chamber extend through the hob plate.

The hob plate may have an aperture through which the gas burner is guided. The gas burner is in particular secured at the aperture.

According to a further embodiment, the gas burner includes a nozzle holder and a burner base, wherein the hob plate is arranged between the nozzle holder and the burner base.

For example, the hob plate is clamped in place between the nozzle holder and the burner base. The nozzle holder may for example be screwed to the burner base. The nozzle holder is in particular arranged below the hob plate and the burner base is arranged above the hob plate.

According to a further embodiment, the first mixing chamber and the second mixing chamber are provided in the burner base.

The burner base is in particular made as an integrally formed part. The burner base may for example be a die-cast aluminum part or a die-cast magnesium part. The burner base includes a disk-shaped underlying portion from which there extend a first conical or cylindrical wall associated with the first mixing chamber, and a second conical or cylindrical wall associated with the second mixing chamber. The first mixing chamber is in particular provided centered on the burner base. The second mixing chamber may be positioned eccentrically. In particular, the first mixing chamber is constructed to be rotationally symmetrical about an axis of symmetry of the gas burner.

According to a further embodiment, a first gas nozzle for injecting the combustion gas into the first mixing chamber, and a second gas nozzle for injecting the combustion gas into the second mixing chamber are received in the nozzle holder.

The first gas nozzle and the second gas nozzle are associated with the nozzle holder.

For example, the gas nozzles are screwed into the nozzle holder. For this purpose, corresponding bores may be provided in the nozzle holder, and with the aid of these the combustion gas may also be supplied to the gas nozzles.

According to a further embodiment, the first gas nozzle is arranged at a spacing from an inflow edge of the first mixing chamber, and the second gas nozzle is arranged at a spacing from an inflow edge of the second mixing chamber.

That is to say that the first gas nozzle is arranged outside the first mixing chamber and the second gas nozzle is arranged outside the second mixing chamber.

According to a further embodiment, the nozzle holder includes a pot-shaped nozzle receiving portion in which the second gas nozzle is received.

In the present document, the term "pot-shaped" should be understood to mean that the nozzle receiving portion has a bottom and a wall that runs peripherally around the bottom. The wall is closed. That is to say that the wall has no apertures or bores. An upper edge of the wall may be part of a bearing surface for the nozzle holder. By means of the bearing surface, the nozzle holder bears on the rear side of the hob plate. Provided in the bottom of the nozzle receiving portion there may be a bore into which the second gas nozzle is screwed.

According to a further embodiment, the second mixing chamber is at least in certain regions received in the nozzle receiving portion.

That is to say that the second mixing chamber projects into the nozzle receiving portion. A cavity that is surrounded by the nozzle receiving portion penetrates the bearing surface of the nozzle holder. The cavity is in fluidic connection with the second primary air opening by way of the aperture provided in the hob plate.

According to a further embodiment, the at least one first primary air opening is guided through the nozzle holder.

Preferably, two first primary air openings are provided, which supply the primary air laterally to the first gas nozzle. However, it is also possible to provide only one first primary air opening.

According to a further embodiment, the at least one second primary air opening is guided through the burner base.

In particular, the second primary air opening may take the form of a bore provided in an underlying portion of the burner base. There may be any desired number of second primary air openings. For example, five second primary air openings may be provided.

According to a further embodiment, the gas burner includes a first mixture distribution chamber that is in fluidic connection with the first mixing chamber, and a second mixture distribution chamber, separate from the first mixture distribution chamber, that is in fluidic connection with the second mixing chamber.

The expression that the first mixture distribution chamber is separate from the second mixture distribution chamber should be understood to mean that preferably no fluidic connection is made between the first mixture distribution chamber and the second mixture distribution chamber. However, a connection between the mixture distribution chambers may also be made with the aid of an optional aperture provided in an intermediate element of the gas burner.

According to a further embodiment, the gas burner includes a burner lid and an intermediate element that is arranged between the burner lid and the burner base.

The burner lid and the intermediate element may likewise be made out of a die-cast aluminum part or a die-cast magnesium part. The nozzle holder, the burner base, the intermediate element and the burner lid form a burner casing of the gas burner. The nozzle holder, the burner base, the intermediate element and the burner lid are mutually separate parts.

According to a further embodiment, the first mixture distribution chamber is arranged between the burner lid and the intermediate element, and the second mixture distribution chamber is arranged between the intermediate element and the burner base.

That is to say that the intermediate element separates the first mixture distribution chamber spatially and preferably also fluidically from the second mixture distribution chamber.

According to a further embodiment, the intermediate element includes a plurality of first mixture outlet openings that are associated with the first mixture distribution chamber, and a plurality of second mixture outlet openings that are associated with the second mixture distribution chamber.

In particular, the first mixture distribution chamber is intended to distribute the mixture of combustion gas and primary air evenly to the first mixture outlet openings, and the second mixture distribution chamber is intended to distribute the mixture of combustion gas and primary air evenly to the second mixture outlet openings. The mixture outlet openings are respectively arranged in an even distribution around a periphery of the intermediate element. There may be any desired number of respective mixture outlet openings. The first mixture outlet openings may form a first flame ring of the gas burner, and the second mixture outlet openings may form a second flame ring of the gas burner.

Moreover, a household cooking appliance, in particular a gas cooker, having a gas burner arrangement of this kind is proposed.

Preferably, the household cooking appliance has a gas burner arrangement of this kind with a plurality of gas burners. A gas regulating valve or gas control valve may be associated with each gas burner. The gas control valve may be intended to regulate, continuously variably or in steps, a volumetric flow of combustion gas to the first gas nozzle and/or the second gas nozzle. Here, depending on the position of an operating knob of the gas control valve, it is possible to supply combustion gas either only to the first gas nozzle or only to the second gas nozzle, or to both gas nozzles at once. It is also possible for the gas control valve to be a so-called step valve.

The household cooking appliance may be a free-standing appliance or a built-in appliance. Preferably, the household appliance is a household gas cooker. For example, the household cooking appliance may have four gas burners. The gas control valve is connected up to a main gas line of the household cooking appliance, and is fluidically connected to the gas burner associated therewith by way of two gas supply lines, one for the first gas nozzle and one for the second gas nozzle. Moreover, there may also be associated with each gas burner an ignition device that may be integrated into the gas control valve, and an ignition element that is arranged directly on the gas burner—for example an igniter. Moreover, each gas burner may also have a thermocouple for monitoring the flame. The thermocouple is electrically connected to the gas control valve of the respective gas burner.

Further possible implementations of the gas burner arrangement and/or the household cooking appliance also include features or embodiments, described above or below in relation to the exemplary embodiments, in combinations that are not explicitly mentioned. In this context, those skilled in the art will also incorporate individual aspects as improvements or additions to the respective basic form of the gas burner arrangement and/or the household cooking appliance.

BRIEF DESCRIPTION OF THE DRAWINGS

Further advantageous configurations and aspects of the gas burner arrangement and/or the household cooking appliance form the subject-matter of the subclaims, and the exemplary embodiments described below, of the gas burner arrangement and/or the household cooking appliance. Below, the gas burner arrangement and/or the household cooking appliance will be explained in more detail on the basis of preferred embodiments, with reference to the attached figures.

FIG. 6 shows a further schematic exploded cross-sectional view of the gas burner arrangement according to FIG. 3;

DETAILED DESCRIPTION OF EXEMPLARY EMBODIMENTS OF THE PRESENT INVENTION

Figure 1:
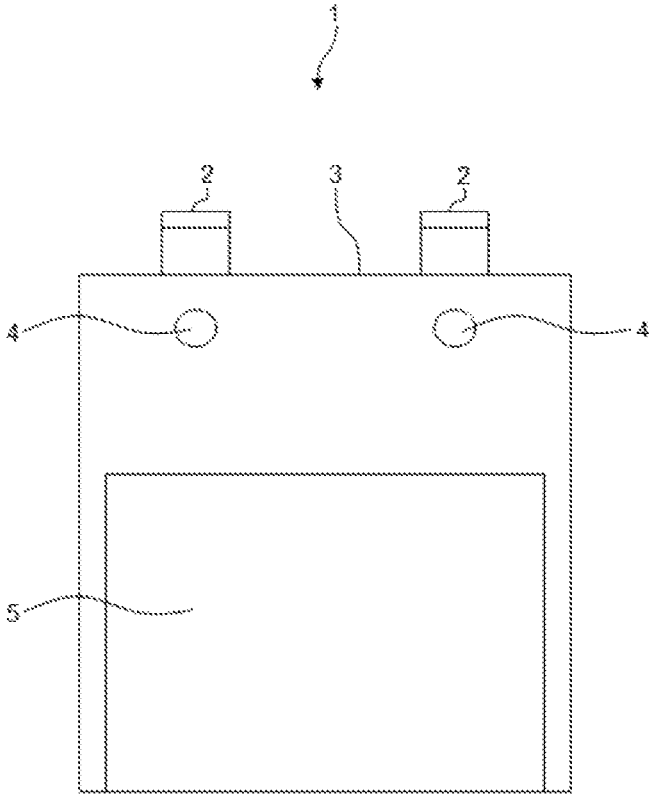
FIG. 1 shows a schematic view of an embodiment of a household cooking appliance.

In the figures, like or functionally equivalent elements are provided with the same reference characters unless indicated otherwise.

FIG. 1 shows a schematic view of an embodiment of a household cooking appliance 1. The household cooking appliance 1 is in particular a gas cooker or household gas cooker. The household cooking appliance 1 may be a built-in appliance or a free-standing appliance. The household cooking appliance 1 includes a plurality of gas burners 2. The gas burners 2 may also be designated as household appliance gas burners. There may be any desired number of gas burners 2. For example, four gas burners 2 may be provided. The gas burners 2 are arranged on a common hob plate 3. For example, the gas burners 2 may be secured to the hob plate 3. The gas burners 2 may each have a heat shield that runs peripherally around them in a ring and is intended to protect the hob plate 3 from being heated by the dissipation of heat by the gas burners 2.

The hob plate 3 may be for example a steel sheet, a glass ceramic plate or a plate of tempered glass. Associated with each gas burner 2 is a gas regulating valve or gas control valve 4, with the aid of which a stream of combustion gas that is supplied may be selectively switched on, switched off and, in particular continuously variably, adjusted for each gas burner 2. As an alternative, the gas control valves 4 may also be intended to regulate in steps the stream of combustion gas supplied to the respective gas burner 2. That is to say that the gas control valves 4 may take the form of stepped gas control valves, or so-called step valves. Moreover, the household cooking appliance 1 may include a door 5 provided on the front side. The door 5 may for example be an oven door. For the purpose of being opened and closed, the door 5 may be pivoted about a pivot axis provided at a lower end of the door 5. As an alternative, the door 5 may be arranged on an oven carriage that may be pulled out of the household cooking appliance 1.

Figure 2:
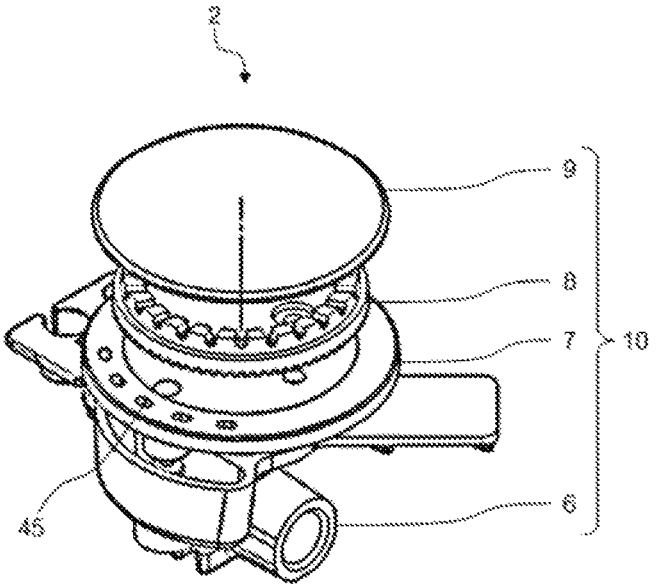
FIG. 2 shows a schematic exploded view of an embodiment of a gas burner for the household cooking appliance according to FIG. 1.

FIG. 2 shows a schematic exploded perspective view of an embodiment of a gas burner 2. The gas burner 2 includes a nozzle holder 6, a burner base 7 arranged on the nozzle holder 6, an intermediate element 8 arranged on the burner base 7, and a burner lid 9 arranged on the intermediate element 8. Here, the burner base 7 is arranged between the nozzle holder 6 and the intermediate element 8, and the intermediate element 8 is arranged between the burner base 7 and the burner lid 9.

The nozzle holder 6, the burner base 7, the intermediate element 8 and the burner lid 9 are each made for example of an aluminum alloy or a magnesium alloy. For example, the nozzle holder 6, the burner base 7, the intermediate element 8 and the burner lid 9 may be die-cast aluminum parts or die-cast magnesium parts. The nozzle holder 6, the burner base 7, the intermediate element 8 and the burner lid 9 are mutually separate parts that together form a burner casing 10 of the gas burner 2.

Figure 3:
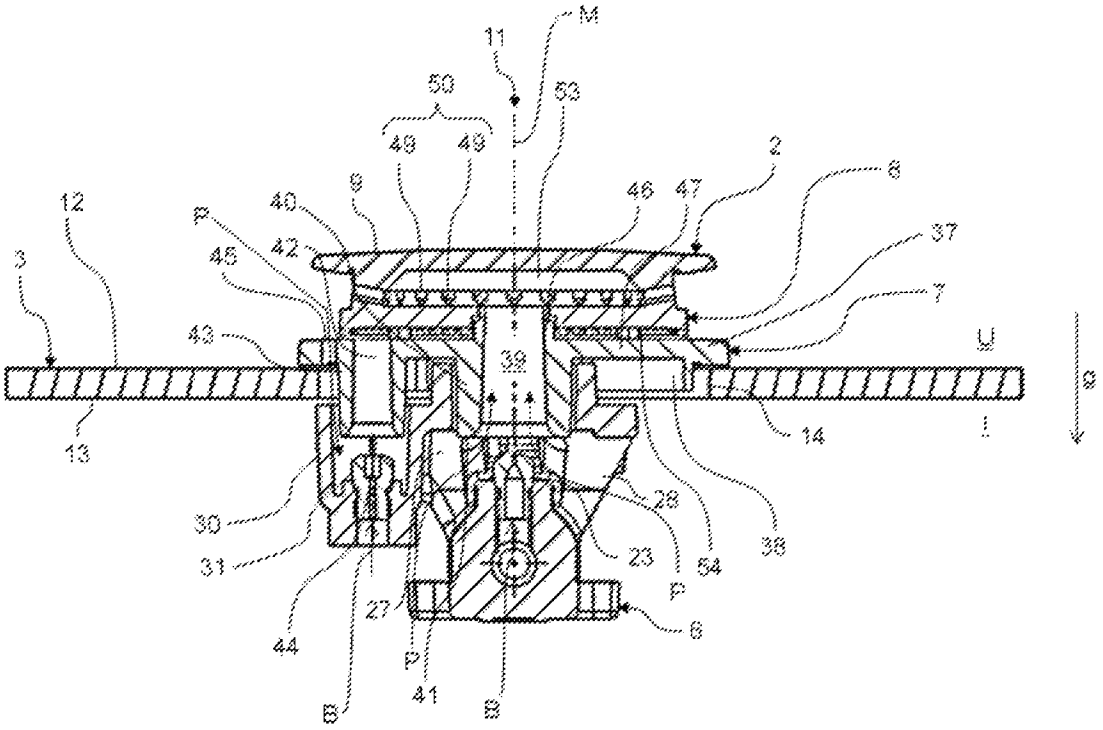
FIG. 3 shows a schematic sectional view of a gas burner arrangement with a gas burner according to FIG. 1.
Figure 4:
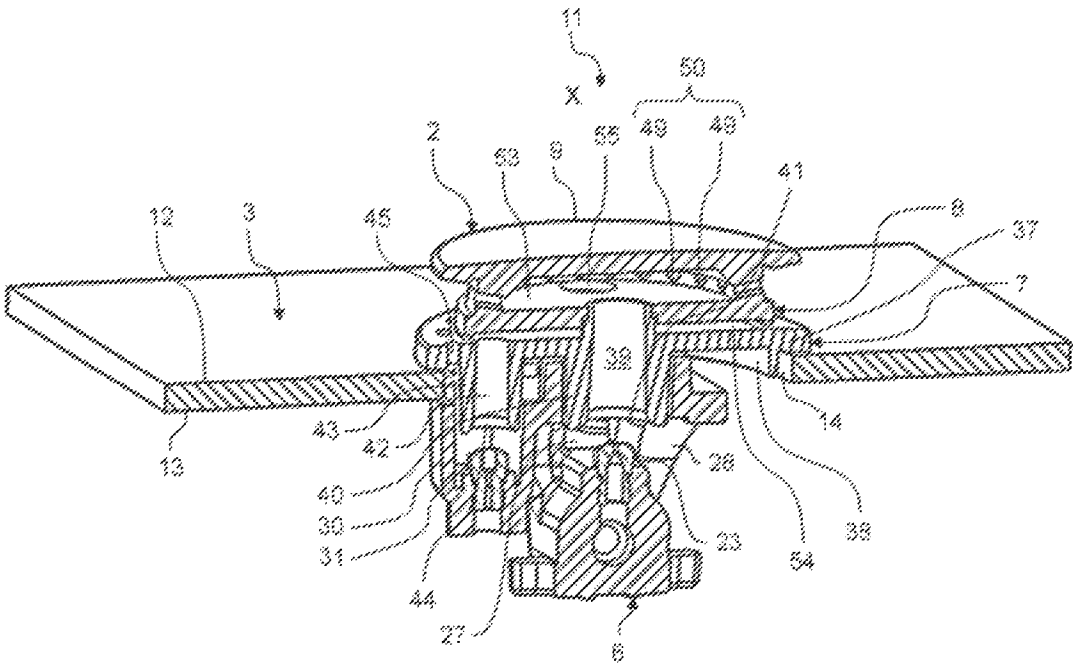
FIG. 4 shows a further schematic sectional view of the gas burner arrangement according to FIG. 3.
Figure 5:
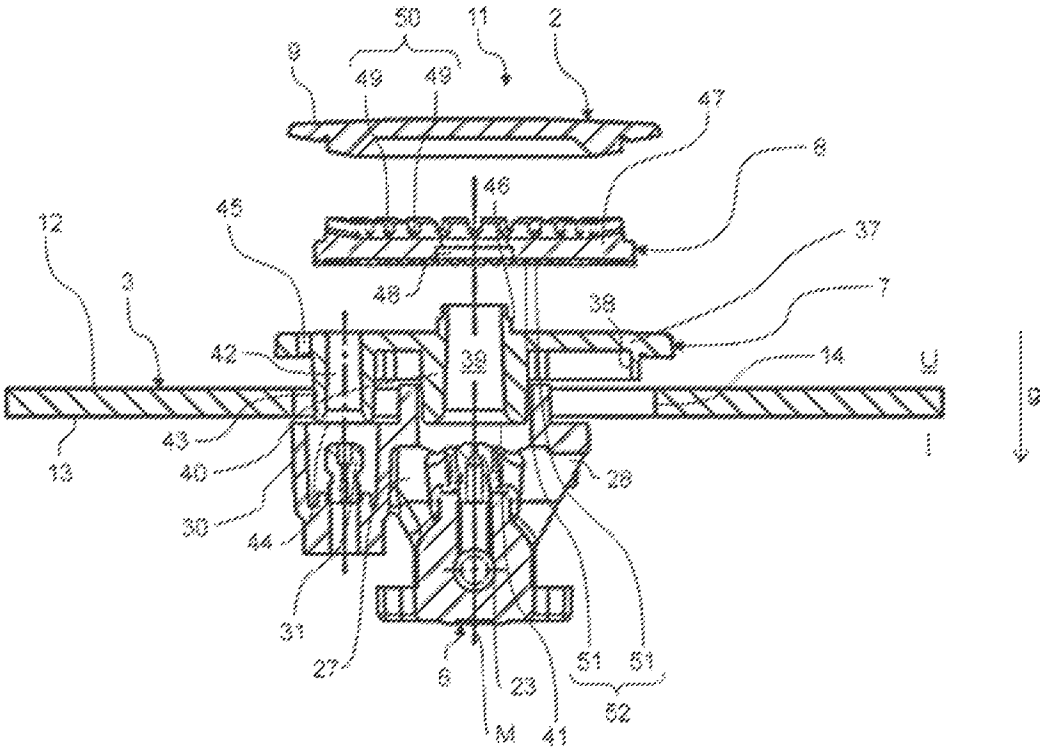
FIG. 5 shows a schematic exploded cross-sectional view of the gas burner arrangement according to FIG. 3.

FIGS. 3 and 4 each show a schematic sectional view of an embodiment of a gas burner arrangement 11 with a gas burner 2 of this kind. FIGS. 5 and 6 each show a schematic exploded cross-sectional view of the gas burner arrangement 11. Reference is made simultaneously to FIGS. 3 to 6 below.

The gas burner arrangement 11 includes one or more gas burners 2 and the hob plate 3. The hob plate 3 includes an upper side or front side 12, and a lower side or rear side 13. As seen in a direction of gravity g, the rear side 13 is arranged below the front side 12. The hob plate 3 includes an aperture 14 through which the gas burner 2 is guided. An aperture 14 of this kind may be associated with each gas burner 2. The aperture 14 may have a circular geometry. However, it is also possible for the aperture 14 to have any other desired geometry.

Figure 7:
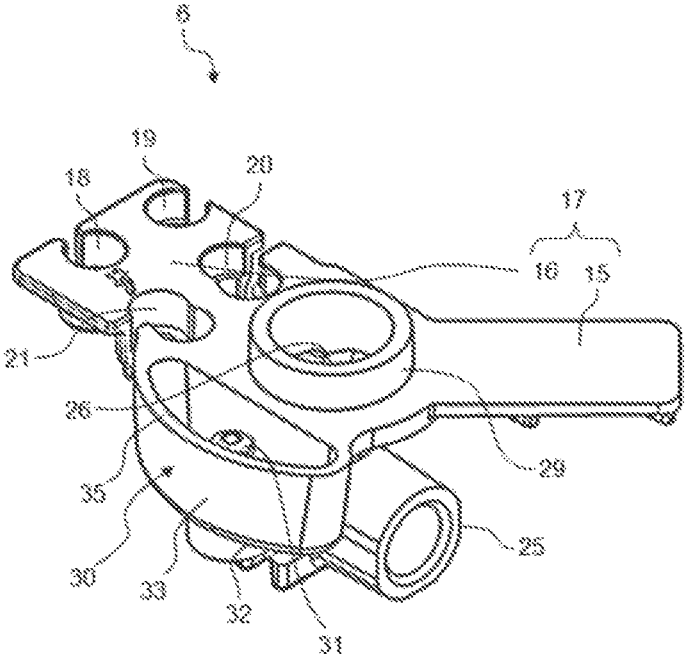
FIG. 7 shows a schematic perspective view of an embodiment of a nozzle holder for the gas burner according to FIG. 2.
Figure 8:
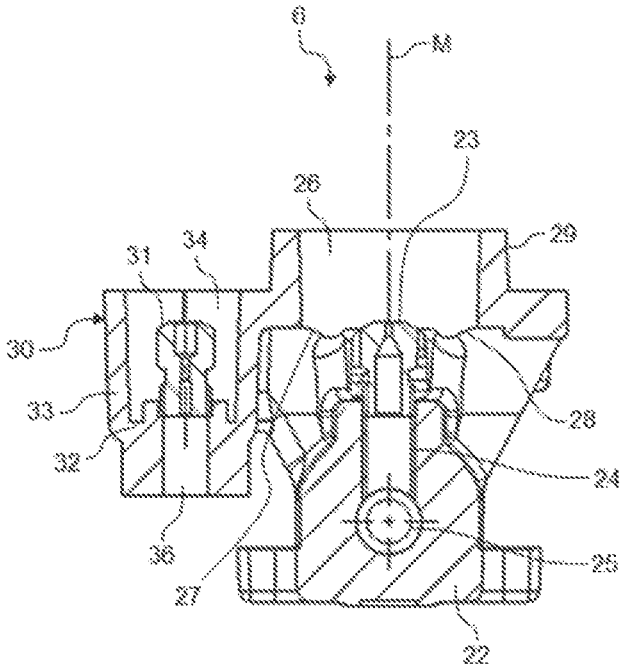

As shown in FIG. 7, the nozzle holder 6 includes a first bearing finger 15 and a second bearing finger 16. The bearing fingers 15, 16 are positioned at an angle to one another. The bearing fingers 15, 16 are part of a bearing surface 17 of the nozzle holder 6. The nozzle holder 6 bears against the rear side 13 of the hob plate 3 by means of the bearing surface 17. The second bearing finger 16 may have a plurality of receiving portions 18 to 21 in which an ignition element or thermocouple may be received. A thermocouple and an ignition element are associated with each gas burner 2.

Figure 8:
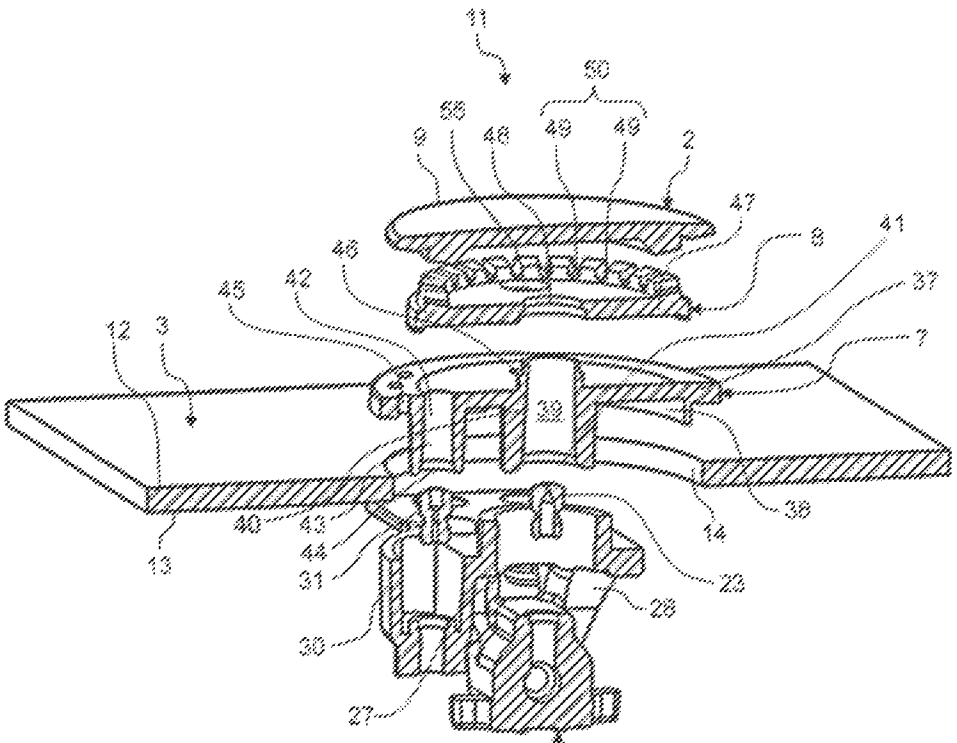
FIG. 8 shows a schematic sectional view of the nozzle holder according to FIG. 7.

The nozzle holder 6 includes an underlying body 22 (FIG. 8) in which a first gas nozzle 23 is received. A bore 24, which may for example take the form of a threaded bore, is made in the underlying body 22. The first gas nozzle 23 is screwed into the bore 24. The bore 24 is in fluidic connection with a connector 25 of the nozzle holder 6. A gas supply line (not shown) may be connected to the connector 25. In this way, a combustion gas may be supplied to the first gas nozzle 23 by way of the connector 25 and the bore 24.

Further provided in the underlying body 22 is a receiving portion 26 in which, at least in certain regions, the burner base 7 may be received. The receiving portion 26 may be constructed to be rotationally symmetrical about a center axis or axis of symmetry M of the gas burner 2. The first gas nozzle 23 is preferably likewise formed such that it is rotationally symmetrical about the axis of symmetry M. The receiving portion 26 may have a cylindrical geometry. However, the receiving portion 26 may also widen conically from the first gas nozzle 23 toward the bearing surface 17. Moreover, two first primary air openings 27, 28 are provided in the underlying body 22, and primary air P may be supplied to the first gas nozzle 23 with the aid of these.

Moreover, the nozzle holder 6 includes a flange 29 that extends above the bearing surface 17 and runs peripherally around the receiving portion 26. The flange 29 preferably takes the form of a ring. The flange 29 may, at least in certain regions, extend into the aperture 14 in the hob plate 3, or extend through it.

The nozzle holder 6 moreover includes a pot-shaped nozzle receiving portion 30 that is made in one piece with the underlying body 22. In particular, the nozzle receiving portion 30 is integrally formed with the underlying body 22. A second gas nozzle 31 is received in the nozzle receiving portion 30. The expression that the nozzle receiving portion 30 is pot-shaped should be understood to mean that it has a bottom 32 and a wall 33 that runs peripherally around the bottom 32. The expression that the wall 33 is closed should be understood to mean that it has no apertures or bores.

The nozzle receiving portion 30 is open in the direction of the bearing surface 17, or the direction of the rear side 13 of the hob plate 3. The nozzle receiving portion 30 encloses a cavity 34 in which the gas nozzle 31 is received. The cavity 34 penetrates the bearing surface 17. That is to say that an upper edge 35 of the wall 33 is part of the bearing surface 17. A bore 36 is made in, and penetrates, the bottom 32. The second gas nozzle 31 is received in the bore 36. For example, the second gas nozzle 31 is screwed into the bore 36. A gas supply line (not shown) may be connected at the bore 36 for the purpose of supplying combustion gas to the second gas nozzle 31.

Referring again to FIGS. 3 to 6, the burner base 6 includes a disk-shaped underlying portion 37, which may be constructed to be rotationally symmetrical about the axis of symmetry M, and a flange 38 that extends out of the underside of the underlying portion 37. The flange 38 is intended to bear against the inside of the aperture 14 of the hob plate 3. A first mixing chamber 39 is provided centered on the underlying portion 37 and rotationally symmetrical about the axis of symmetry M. The first mixing chamber 39 may taper conically from the first gas nozzle 23 toward the burner lid 9. The first mixing chamber 39 includes a wall 40 that is constructed to be tubular and rotationally symmetrical about the axis of symmetry M and is received in the receiving portion 26 of the nozzle holder 6. The first mixing chamber 39 moreover has an inflow edge 41 provided on the wall 40.

Moreover, a second mixing chamber 42 extends out of the underlying portion 37 in the direction of the nozzle receiving portion 30 of the nozzle holder 6. The second mixing chamber 42 includes a wall 43 and an inflow edge 44. The inflow edge 44 runs peripherally around the wall 43 in a ring. As shown by FIGS. 3 and 4, the second mixing chamber 42 is, at least in certain regions, received in the nozzle receiving portion 30. Here, the second gas nozzle 31 is arranged outside the second mixing chamber 42, and the first gas nozzle 23 is positioned outside the first mixing chamber 39. In particular, the first gas nozzle 23 is arranged at a spacing from the inflow edge 41 of the first mixing chamber 39, and the second gas nozzle 31 is positioned at a spacing from the inflow edge 44 of the second mixing chamber 42.

Further, a plurality of second primary air openings 45 is provided in the underlying portion 37 of the burner base 7, and these are in fluidic connection with the cavity 34 of the nozzle receiving portion 30. In particular, the second primary air openings 45 are in fluidic connection with the cavity 34 of the nozzle receiving portion 30 by way of the aperture 14 in the hob plate 3. That is to say that primary air P can be supplied to the nozzle receiving portion 30 by way of the second primary air openings 45 and the aperture 14 of the hob plate 3 (FIG. 3). As shown by FIG. 2, five such second primary air openings 45 may be provided. However, there may be any desired number of second primary air openings 45. Unlike the first primary air openings 27, 28, the second primary air openings 45 are positioned not below but above the hob plate 3.

On the upper side of the underlying portion 37 there extends a flange 46 that is constructed to be rotationally symmetrical about the axis of symmetry M. The first mixing chamber 39 passes through the flange 46. The flange 46 has a stepped upper edge.

The intermediate element 8 is constructed to be rotationally symmetrical about the axis of symmetry M, and includes a disk-shaped underlying portion 47. Centered on the underlying portion 47 is an aperture 48 that is stepped in a manner corresponding to the flange 46. The flange 46 of the burner base 7 is received in the aperture 48. In particular, the flange 46 is supported on the aperture 48.

On the upper side—that is to say facing the burner lid 9—the intermediate element 8 has a plurality of duct-shaped first mixture outlet openings 49. There may be any desired number of first mixture outlet openings 49. Preferably, the first mixture outlet openings 49 are arranged evenly distributed around a periphery of the intermediate element 8. The first mixture outlet openings 49 are part of a first flame ring 50 of the gas burner 2.

On the underside—that is to say associated with the burner base 7—the intermediate element 8 includes a plurality of second mixture outlet openings 51. There may be any desired number of second mixture outlet openings 51. Preferably, the second mixture outlet openings 51 are arranged evenly distributed around a periphery of the intermediate element 8. The second mixture outlet openings 51 are part of a second flame ring 52 (FIG. 5) of the gas burner 2.

Between the burner lid 9 and the intermediate element 8 there is provided a first mixture distribution chamber 53 with which the first mixture outlet openings 49 are associated. Between the intermediate element 8 and the burner base 7 there is provided a second mixture distribution chamber 54 with which the second mixture outlet openings 51 are associated. Here, the first mixture distribution chamber 53 is not in fluidic connection with the second mixture distribution chamber 54. The mixture distribution chambers 53, 54 are separated from one another with the aid of the intermediate element 8. However, the mixture distribution chambers 53, 54 may also be connected to one another with the aid of an optional aperture 55 in the underlying portion 47. The first mixture distribution chamber 53 is in fluidic connection with the first mixing chamber 39, and the second mixture distribution chamber 54 is in fluidic connection with the second mixing chamber 42.

The functionality of the gas burner arrangement 11 and the gas burner 2 is explained below with reference to FIG. 3. As explained above, the gas burner 2 includes a first flame ring 50 and a second flame ring 52. The first flame ring 50 is associated for example with a maximum burning operation of the gas burner 2. The second flame ring 52 may be suitable for a minimum burning operation of the gas burner 2. In maximum burning operation, in particular both flame rings 50, 52 may be operated. During operation of the gas burner 2, the combustion gas B is supplied to the first gas nozzle 23 and the second gas nozzle 31. In this arrangement, the combustion gas B is supplied with the aid of the bores 24, 36 shown in FIG. 8.

The combustion gas B streams out of the first gas nozzle 23 and into the first mixing chamber 39. During this, primary air P is drawn in by suction, laterally through the first primary air openings 27, 28, and streams over the inflow edge 41 of the first mixing chamber 39 and into the latter. As a result of the combustion gas B streaming out, a Venturi effect is generated, and this draws the primary air P in by suction from below the hob plate 3, out of an inner space I of the household cooking appliance 1. The combustion gas B is mixed with the primary air P in the first mixing chamber 39 to form a mixture of combustion gas and primary air, and this is supplied to the first mixture distribution chamber 53. From the first mixture distribution chamber 53, the mixture of combustion gas and primary air is distributed evenly over the first mixture outlet openings 49 and streams out of these into an area U surrounding the gas burner arrangement 11. With a supply of secondary air, the mixture of primary air and combustion gas burns, forming a first burner flame.

In an analogous manner, the combustion gas B streams out of the second gas nozzle 31 and into the second mixing chamber 42. As a result of the combustion gas B streaming in, primary air P is drawn in by suction, from above the hob plate 3, through the second primary air openings 45, and supplied to the nozzle receiving portion 30. The primary air P is then drawn in by suction, over the inflow edge 44 and into the second mixing chamber 42, where it is mixed with the combustion gas B to form the mixture of combustion gas and primary air. From the second mixing chamber 42, the mixture of combustion gas and primary air is supplied to the second mixture distribution chamber 54, and from there it is distributed over the second mixture outlet openings 51. The mixture of combustion gas and primary air then streams out of the gas burner 2 and burns at the surrounding area U, forming a second burner flame.

Because the second primary air openings 45 draw the primary air P in from above the hob plate 3—that is to say out of the surrounding air U—and not, like the first primary air openings 27, 28, from below the hob plate 3, or the inner space I of the household cooking appliance 1, it is possible, in particular in a minimum burning operation of the gas burner 2, to reliably prevent the gas burner 2 from being extinguished, for example as a result of pressure pulses, which may be caused by opening or closing the door 5.

The invention claimed is:

1. A gas burner arrangement for a household cooking appliance, said gas burner arrangement comprising:

a hob plate; and a gas burner mounted on the hob plate, said gas burner including a first mixing chamber for mixing combustion gas with primary air, a second mixing chamber, separate from the first mixing chamber, for mixing combustion gas with primary air, at least one first primary air opening for supplying primary air to the first mixing chamber, and at least one second primary air opening for supplying primary air to the second mixing chamber, said at least one first primary air opening being arranged below the hob plate and the at least one second primary air opening being arranged above the hob plate, wherein the gas burner includes a nozzle holder and a burner base, said hob plate being arranged between the nozzle holder and the burner base, wherein the burner base includes an underlying portion, and wherein the at least one second primary air opening extends through the underlying portion of the burner base.

2. The gas burner arrangement of claim 1, wherein the first mixing chamber and the second mixing chamber extend through the hob plate.

3. The gas burner arrangement of claim 1, wherein the first mixing chamber and the second mixing chamber are provided in the burner base.

4. The gas burner arrangement of claim 1, further comprising a first gas nozzle received in the nozzle holder for injecting the combustion gas into the first mixing chamber, and a second gas nozzle received in the nozzle holder for injecting the combustion gas into the second mixing chamber.

5. The gas burner arrangement of claim 4, wherein the first gas nozzle is arranged at a spacing from an inflow edge of the first mixing chamber, and the second gas nozzle is arranged at a spacing from an inflow edge of the second mixing chamber.

6. The gas burner arrangement of claim 4, wherein the nozzle holder includes a pot-shaped nozzle receiving portion in which the second gas nozzle is received.

7. The gas burner arrangement of claim 6, wherein the second mixing chamber is received in at least one region of the nozzle receiving portion.

8. The gas burner arrangement of claim 1, wherein the at least one first primary air opening is guided through the nozzle holder.

9. The gas burner arrangement of claim 1, wherein the gas burner includes a first mixture distribution chamber in fluidic connection with the first mixing chamber, and a second mixture distribution chamber, separate from the first mixture distribution chamber, in fluidic connection with the second mixing chamber.

10. The gas burner arrangement of claim 1, wherein the gas burner includes a burner lid and an intermediate element arranged between the burner lid and the burner base.

11. A gas burner arrangement for a household cooking appliance, said gas burner arrangement comprising:

a hob plate; and a gas burner mounted on the hob plate, said gas burner including a first mixing chamber for mixing combustion gas with primary air, a second mixing chamber, separate from the first mixing chamber, for mixing combustion gas with primary air, at least one first primary air opening for supplying primary air to the first mixing chamber, and at least one second primary air opening for supplying primary air to the second mixing chamber, said at least one first primary air opening being arranged below the hob plate and the at least one second primary air opening being arranged above the hob plate, wherein the gas burner includes a burner lid and an intermediate element arranged between the burner lid and the burner base, said first mixture distribution chamber being arranged between the burner lid and the intermediate element, and the second mixture distribution chamber being arranged between the intermediate element and the burner base.

12. A gas burner arrangement for a household cooking appliance, said gas burner arrangement comprising:

a hob plate; and a gas burner mounted on the hob plate, said gas burner including a first mixing chamber for mixing combustion gas with primary air, a second mixing chamber, separate from the first mixing chamber, for mixing combustion gas with primary air, at least one first primary air opening for supplying primary air to the first mixing chamber, and at least one second primary air opening for supplying primary air to the second mixing chamber, said at least one first primary air opening being arranged below the hob plate and the at least one second primary air opening being arranged above the hob plate, wherein the gas burner includes a burner lid and an intermediate element arranged between the burner lid and the burner base, said intermediate element including a plurality of first mixture outlet openings associated with the first mixture distribution chamber, and a plurality of second mixture outlet openings associated with the second mixture distribution chamber.

13. A household cooking appliance, in particular a gas cooker, comprising a gas burner arrangement, said gas burner arrangement comprising a hob plate, and a gas burner mounted on the hob plate, said gas burner including a first mixing chamber for mixing combustion gas with primary air, a second mixing chamber, separate from the first mixing chamber, for mixing combustion gas with primary air, at least one first primary air opening for supplying primary air to the first mixing chamber, and at least one second primary air opening for supplying primary air to the second mixing chamber, said at least one first primary air opening being arranged below the hob plate and the at least one second primary air opening being arranged above the hob plate, wherein the gas burner includes a nozzle holder and a burner base, said hob plate being arranged between the nozzle holder and the burner base, wherein the burner base includes an underlying portion, and wherein the at least one second primary air opening extends through the underlying portion of the burner base.

14. The household cooking appliance of claim 13, wherein the first mixing chamber and the second mixing chamber extend through the hob plate.

15. The household cooking appliance of claim 13, wherein the first mixing chamber and the second mixing chamber are provided in the burner base.

16. The household cooking appliance of claim 13, wherein the gas burner arrangement includes a first gas nozzle received in the nozzle holder for injecting the combustion gas into the first mixing chamber, and a second gas nozzle received in the nozzle holder for injecting the combustion gas into the second mixing chamber.

17. The household cooking appliance of claim 16, wherein the first gas nozzle is arranged at a spacing from an inflow edge of the first mixing chamber, and the second gas nozzle is arranged at a spacing from an inflow edge of the second mixing chamber.

18. The household cooking appliance of claim 16, wherein the nozzle holder includes a pot-shaped nozzle receiving portion in which the second gas nozzle is received.

19. The household cooking appliance of claim 18, wherein the second mixing chamber is received in at least one region of the nozzle receiving portion.

20. The household cooking appliance of claim 13, wherein the at least one first primary air opening is guided through the nozzle holder.

21. The household cooking appliance of claim 13, wherein the gas burner includes a first mixture distribution chamber in fluidic connection with the first mixing chamber, and a second mixture distribution chamber, separate from the first mixture distribution chamber, in fluidic connection with the second mixing chamber.

22. The household cooking appliance of claim 13, wherein the gas burner includes a burner lid and an intermediate element arranged between the burner lid and the burner base.

23. A household cooking appliance, in particular a gas cooker, comprising a gas burner arrangement, said gas burner arrangement comprising a hob plate, and a gas burner mounted on the hob plate, said gas burner including a first mixing chamber for mixing combustion gas with primary air, a second mixing chamber, separate from the first mixing chamber, for mixing combustion gas with primary air, at least one first primary air opening for supplying primary air to the first mixing chamber, and at least one second primary air opening for supplying primary air to the second mixing chamber, said at least one first primary air opening being arranged below the hob plate and the at least one second primary air opening being arranged above the hob plate, wherein the gas burner includes a first mixture distribution chamber in fluidic connection with the first mixing chamber, and a second mixture distribution chamber, separate from the first mixture distribution chamber, in fluidic connection with the second mixing chamber, and wherein the gas burner includes a burner lid and an intermediate element arranged between the burner lid and the burner base, said first mixture distribution chamber being arranged between the burner lid and the intermediate element, and the second mixture distribution chamber being arranged between the intermediate element and the burner base.

24. A household cooking appliance, in particular a gas cooker, comprising a gas burner arrangement, said gas burner arrangement comprising a hob plate, and a gas burner mounted on the hob plate, said gas burner including a first mixing chamber for mixing combustion gas with primary air, a second mixing chamber, separate from the first mixing chamber, for mixing combustion gas with primary air, at least one first primary air opening for supplying primary air to the first mixing chamber, and at least one second primary air opening for supplying primary air to the second mixing chamber, said at least one first primary air opening being arranged below the hob plate and the at least one second primary air opening being arranged above the hob plate, wherein the gas burner includes a first mixture distribution chamber in fluidic connection with the first mixing chamber, and a second mixture distribution chamber, separate from the first mixture distribution chamber, in fluidic connection with the second mixing chamber, and wherein the gas burner includes a burner lid and an intermediate element arranged between the burner lid and the burner base, said intermediate element including a plurality of first mixture outlet openings associated with the first mixture distribution chamber, and a plurality of second mixture outlet openings associated with the second mixture distribution chamber.

25. The gas burner arrangement of claim 1, wherein the at least one second primary air opening includes a plurality of bores extending through the underlying portion of the burner base.

26. The gas burner arrangement of claim 1, wherein the at least one second primary air opening cooperates with an aperture of the hob plate to supply the primary air from above the burner base to an inflow edge of the second mixing chamber below the hob plate.

27. The household cooking appliance of claim 13, wherein the at least one second primary air opening includes a plurality of bores extending through the underlying portion of the burner base.

28. The household cooking appliance of claim 13, wherein the at least one second primary air opening cooperates with an aperture of the hob plate to supply the primary air from above the burner base to an inflow edge of the second mixing chamber below the hob plate.

* * * * *